United States Patent [19]

Shin et al.

[11] Patent Number: 4,857,433

[45] **Date of Patent: * Aug. 15, 1989**

[54] ELECTROPHOTOGRAPHIC TONER FOR HIGH SPEED ELECTROPHOTOGRAPHY

[75] Inventors: Masaaki Shin, Fujisawa; Akio Fujiwara; Hiroshi Taniwaki, both of Yokohama, all of Japan

[73] Assignee: Mitsui Toatsu Chemicals, Incorporated, Tokyo, Japan

[ * ] Notice: The portion of the term of this patent subsequent to Feb. 23, 2005 has been disclaimed.

[21] Appl. No.: 105,577

[22] Filed: Oct. 8, 1987

Related U.S. Application Data

[63] Continuation of Ser. No. 891,177, Jul. 31, 1986, Pat. No. 4,727,010.

[51] Int. Cl.[4] ..... G03G 13/08

[52] U.S. Cl. ..... 430/120; 430/109

[58] Field of Search ..... 430/120, 109

[56] References Cited

U.S. PATENT DOCUMENTS

| | | | |
|---|---|---|---|
| 2,297,691 | 10/1942 | Carlson | 430/120 |
| 4,246,332 | 1/1981 | Tanaka | 430/109 |
| 4,298,672 | 11/1981 | Lu | 430/110 |
| 4,331,755 | 5/1982 | Gilliams | 430/106 |

*Primary Examiner*—J. David Welsh

*Attorney, Agent, or Firm*—Oblon, Spivak, McClelland, Maier & Neustadt

[57] ABSTRACT

An electrophotographic toner, which can exhibit good fixation in high-speed copying and is not affected by an environment such as high humidity, is provided by containing, as a principal component thereof, a resin blend composed of (a) 40–90 wt. % of a vinyl copolymer (I) formed of 70–97 wt. % of an aromatic vinyl monomer, 3–30 wt. % of an alkyl fumarate which is an $C_{1-8}$ monoalkyl or dialkyl ester and 0–5 wt. % of an acid monomer and having a number average molecular weight of 2,000–15,000 and (b) 10–60 wt. % of a vinyl polymer (II) having a number average molecular weight of 20,000–500,000.

9 Claims, No Drawings

ELECTROPHOTOGRAPHIC TONER FOR HIGH SPEED ELECTROPHOTOGRAPHY

This is a continuation of application Ser. No. 891,177 filed July 31, 1986, now U.S. Pat. No. 4,727,010.

BACKGROUND OF THE INVENTION (a) Field of the Invention

This invention relates to an electrophotographic toner, specifically, to a electrophotographic toner which exhibits good fixation in high-speed copying by the heat fixing method and moreover is not affected by an environment such as high humidity and hence has high durability.

(b) Description of the Prior Art

Plain paper copying machines making use of electrophotography or the like and high-speed printers for computer terminals, which rely upon the same principle, have found wide-spread commercial utility in recent years because their ease in operation and their ability in providing copies of excellent quality have been rated high. In the meantime, consistent efforts have been made with a view toward making the copying speed still higher and reducing the machine maintenance work as much as possible. Such improvements have been made not only in copying machines but also toners. Reflecting the improved copying speed, a toner is required to have such properties that toner images can be fixed at a temperature as low as possible. The toner is also required to exhibit anti-offset properties over a temperature range as wide as possible. With such required properties in view, properties of a resin contained in a toner are considered as the most important parameters for obtaining marks of excellent quality consistently during a continuous copying operation without being affected by various environmental conditions.

With a target on such improvement of a resin, it has been known from U.S. Patent No. 3,853,778 to use a crystalline polymer having an amorphous backbone and side-chain crystallinity derived by the polymerization of a monomer having a crystalline alkyl group of at least about 14 carbon atoms. According to the above patent specification, it is indicated that a resin composition obtained by copolymerizing about 70 mole % of docosyl acrylate, which contains a long-chain alkyl group of 22 carbon atoms, or di-n-docosyl fumarate or the like with about 30 mole % of styrene or the like is permanently fixed by its heat fixing at 65° C. for 10 seconds. However, use of such monomers leads to an unavoidable increase in the fixing temperature, thereby failing to achieve good continuous copying performance and at the same time, reduces the blocking resistance significantly. Even when fumaric acid is used instead of di-n-docosyl fumarate on the hand, similar tendency is exhibited in connection with fixation and the triboelectricity is increased. These polymers have thus been found unsuitable for high-speed copying.

SUMMARY OF THE INVENTION

An object of this invention is to provide an electrophotographic toner having excellent fixation so that it shows good fixation even at low temperatures and does not undergo offsetting in a significantly wide temperature range.

Another object of this invention is to provide a toner which can always form marks of the same quality without being affected by environmental conditions and causes relatively small variations in triboelectricity even when copies are made repeatedly under various conditions, for instance, in a continuous high-speed copying operation at 50 copies per minute to provide 10,000 copies in total.

A further object of this invention is to provide an electrophotographic toner having excellent blocking resistance in addition to the above-mentioned various properties.

The above-described objects of the present invention can be fulfilled by an electrophotographic toner of this invention, which comprises as a principal component thereof a resin blend composed of:

40–90 wt. % of a vinyl copolymer (I) formed of 70–97 wt. % of an aromatic vinyl monomer, 3–30 wt. % of an alkyl fumarate which is a $C_{1-8}$ monoalkyl or dialkyl ester and 0–5 wt. % of an acid monomer and having a number average molecular weight of 2,000–15,000; and 10–60 wt. % of a vinyl polymer (II) having a number average molecular weight of 20,000–500,000.

Owing to its excellent various properties, the toner of this invention is suited especially for continuous high-speed copying operations.

The above and other objects, features and 5 advantages of the present invention will become apparent from the following description and the appended claims.

DETAILED DESCRIPTION OF THE INVENTION AND PREFERRED EMBODIMENTS

As the aromatic vinyl monomer which is useful as a constituent unit for the vinyl copolymer (I) in this invention, may be mentioned styrene, α-methylstyrene, p-methylstyrene, vinyltoluene, chlorostyrene or the like. The proportion of the aromatic vinyl monomer to be polymerized may be 70 wt. % or more, preferably, in a range of from 80 wt. % to 97 wt. % in view of ensuring to form marks of excellent quality consistently without being affected by various environmental conditions.

As the alkyl fumarate which is the other constituent unit for the vinyl copolymer (I) in this invention, it is possible to use an alkyl ester in which the carbon number of the alkyl group is 1–8. Specific examples may include mono- and di-methyl, ethyl, propyl, butyl and octyl fumarates. Among these esters, mono- and di-alkyl esters in which the alkyl group contains 4–8 carbon atoms may be used preferably. As to the proportion of the fumarate to be copolymerized, it is necessary to incorporate it in a proportion of 3 wt. % or more in view of fixation at low temperatures. It is however not preferred to incorpo-rate it too much in view of the blocking resistance as a toner. It is therefore necessary to limit the proportion of the alkyl fumarate below 30 wt. %.

In order to permit fixing of a toner at a lower temperature, two approaches may be followed, i.e., to lower the molecular weight of the resin to be used or to increase the proportion of the acrylic component which is a soft component. The former approach results in a problem in anti-offset property whereas the latter approach is accompanied by a problem in stability under a high-humidity environment. Both of these approaches are hence not preferred. When a small amount of a fumaric ester is added to styrene in accordance with the present invention, the hygroscopicity is reduced and as a result, variations in the triboelectricity of a toner are reduced so that marks of uniform quality can always be obtained even under high-humidity conditions.

In the present invention, an acid monomer may be added within a range of 0–5 wt. % in order to control the charging. Illustrative examples of the acid monomer may include methacrylic acid, acrylic acid, itaconic acid, fumaric acid, cinnamic acid, etc. When a monoester of fumaric acid is used as an alkyl fumarate, it is necessary to limit the total proportion of the monoester of fumaric acid and the acid monomer below 5 wt. %.

As the vinyl monomer which is useful as a component for the vinyl monomer (II) in this invention, it is preferable to use, for example, one or more of aromatic vinyl monomers such as styrene, α-methyl-styrene, p-methylstyrene, vinyltoluene and chloro-styrene and (meth)acrylic esters such as methyl acrylate, ethyl acrylate, butyl acrylate, octyl acrylate, lauryl acrylate, stearyl acrylate, methyl methacrylate, ethyl methacrylate, octyl methacrylate, lauryl methacrylate, stearyl methacrylate, hydroxyethyl acrylate, hydroxypropyl acrylate, hydroxyethyl methacrylate, hydroxypropyl methacrylate, glycidyl acrylate, β-methylglycidyl acrylate, glycidyl methacrylate, β-methylglycidyl methacrylate, cyclo-hexyl acrylate, cyclohexyl methacrylate, benzyl acrylate, benzyl methacrylate, tetrahydrofurfuryl acrylate, tetrahydrofurfuryl methacrylate and methoxyethyl methacrylate. It is also possible to use, in combination with the above-exemplified monomer or monomers, a nitrile group containing vinyl monomer such as acrylonitrile or methacrylonitrile, a vinyl ester such as vinyl acetate or vinyl propionate, an unsaturated carboxylic acid such as acrylic acid, methacrylic acid, crotonic acid, itaconic acid, maleic anhydride, maleic acid, fumaric acid or cinnamic acid, a mono- or dialkyl ester of an unsaturated dicarboxylic acid such as monoethyl maleate, monopropyl maleate, monobutyl maleate, monooctyl maleate, monoethyl fumarate, monopropyl fumarate, monobutyl fumarate, monooctyl fumarate, monooctyl itaconate, dibutyl maleate, dibutyl fumarate or dioctyl itaconate, an amido-containing vinyl monomer such as acrylamide, methacrylamide, an alkoxymethylol acrylamide, tert-butyl acrylamide, dimethyl acrylamide or diacetone acrylamide, a nitrogen-containing vinyl monomer such as dimethyl aminoethylmethacrylate, diethyl aminoethyl-methacrylate, vinyl-pyrrolidone or vinylpyridine, or the like.

In the present invention, it is necessary that the number average molecular weight of the vinyl copolymer (I) falls within the range of 2,000–15,000. Any number average molecular weights greater than 15,000 result in poor low-temperature fixation, while any number average molecular weights smaller than 2,000 result in toners having insufficient blocking resistance. It is hence improper to employ any number average molecular weight outside the above range. On the other hand, the number average molecular weight of the vinyl polymer (II) must fall within the range of 20,000–500,000. If the number average molecular weight is smaller than 20,000, the anti-offset property becomes poor. On the other hand, any number average molecular weights greater than 500,000 lead to higher fixing temperatures and hence poor heat fixation. Accordingly, it is unsuitable to use any number average molecular weight outside the above range.

Regarding the proportions of the above-described vinyl copolymer (I) and vinyl polymer (II), it is necessary to contain the vinyl copolymer (I) in a proportion of 40–90 wt. %. Any proportions smaller than 40 wt. % lead to reduced heat fixation and vividness of mark quality, while any proportions greater than 90 wt. % result in poor balancing between heat fixation and anti-offset property. For the reasons mentioned above, a range of 40–80 wt. % is particularly preferred as the proportion of the vinyl copolymer (I).

Although the blending of the vinyl copolymer (I) and vinyl polymer (II) may be achieved by mechanically blending the resins with each other, this method is not preferred because considerable labor is required due to the enormous difference between their melt viscosities. Accordingly, it is rather preferred to mix them in the presence of a solvent and then to remove the solvent. This may preferably be accomplished, for example, by adding and mixing the vinyl polymer (II) to a polymerization mixture, which has been obtained upon completion of polymerization of the vinyl copolymer (I) and contains a solvent, and then removing the solvent; or by adding dropwise the monomers for the vinyl copolymer (I) together with a catalyst to a solution of the vinyl polymer (II) in a solvent, polymerizing the monomers to prepare a solution of a mixture of the vinyl copolymer (I) and vinyl polymer (II) and then removing the solvent.

The toner employed in the present invention is a powder-like dry toner. The above resin blend which is the principal component of the toner is hence required to be solid at room temperature. The resin blend is also required not to develop caking even when left over for a long period of time. From such viewpoints, the glass transition temperature of the resin blend may preferably be above 40° C., more preferably, above 50° C. It is also preferred from the viewpoint of low-temperature fixation that it is softened at a temperature as low as possible. From this viewpoint, its glass transition temperature may preferably be below 90° C., more preferably, below 80° C.

In the present invention, it is also feasible to incorporate, to contents not impairing the effects of the present invention, one or more of other resins such as polyvinyl chloride, polyvinyl acetate, polyolefins, polyesters, polyvinyl butyral, polyurethanes, poly-amides, rosin, modified rosins, terpene resins, phenol resins, aliphatic hydrocarbon resins, aromatic petroleum resins, paraffin wax, polyolefin waxes, etc.

In the present invention, the above-described vinyl copolymer (I) and vinyl polymer (II) are mixed together. Besides, known coloring pigments led by carbon black and magnetite, charge control agents typified by nigrosine and metal-containing azo dyes, pigment dispersants, anti-offset agents and the like are suitably chosen and added to the resin blend. The resulting mixture may then be formed into a toner by usual methods. Namely, after the resin mixture added with the aforementioned various additives is premixed in a powdery state, it is kneaded in a heated and melted state by means of a kneader such as hot rolls, Banbury mixture, extruder or the like. Subsequent to its cooling, it is finely ground in a pulverizer and then classified by a pneumatic classifier. Particles in a range of 10–20 μm are generally collected as a toner The present invention will hereinafter be described more specifically by the following Examples, in which all designations of "part" or "parts" mean part or parts by weight unless otherwise specifically indicated.

The measurement of each weight average molecular weight (Mw) or number average molecular weight (Mn) by GPC (gas permeation chromatography) was conducted under the following conditions:

GPC apparatus: "JASCO TWINCLE" (trade mark) HPLC, manufactured by Japan Spectro-scopic Co., Ltd., Tokyo, Japan.

Detector: "SHODEX RI-SE-31" (trade name), manufactured by Showa Denko K.K. Tokyo, Japan.

Column: "SHODEX GPCA-80M" (trade name), 2 columns, manufactured by Showa Denko K.K., Tokyo, Japan Solvent: Tetrahydrofuran. Flow velocity: 1.2 ml/min.

EXAMPLE 1

In a 4-necked flask fitted with a reflux condenser and stirrer, 1,000 parts of xylene were charged, followed by a dropwise continuous addition of a liquid mixture of 900 parts of styrene, 100 parts of dioctyl fumarate and 30 parts of azo-bis-isobutyro-nitrile (AIBN) over 5 hours. After post-polymerization for additional 1 hour, the polymerization mixture was cooled to 90° C., 5 parts of AIBN were added and any remaining monomers were polymerized in 2 hours. The molecular weight of the resulting vinyl copolymer (A-I) was measured. Mw=8,000, Mn=3,000, Mw/Mn=2.67.

Three hundred parts of polystyrene resin (Mw =50,000, Mn=70,000) were added to 2,000 parts of the above vinyl copolymer (A-I) (50 wt. % solution). The resulting mixture was heated and stirred to dissolve the latter in the former. Thereafter, xylene was distilled off to obtain a resin blend (A).

After kneading 950 parts of the resin blend (A) and 50 parts of carbon black through hot rolls, the resulting mixture was finely ground by a pulverizer and then classified. Particles having particle sizes of 10–20 μm were collected to provide a toner (A).

The above toner was evaluated at a copying speed of 50 copies/minute by a commercial high-speed electrophotographic copying machine equipped with a photosensitive member of amorphous selenium and a "TEFLON" (trade mark) coated hot roll.

Results are shown in Table 1.

EXAMPLE 2

A solution of a vinyl copolymer (B-I) was obtained in exactly the same manner as in Example 1 except that dibutyl fumarate was used instead of dioctyl maleate.

The molecular weight of the vinyl copolymer (B-I) was measured. Mw=8,300, Mn=3,200, Mw/Mn =2.6.

Besides, 600 parts of styrene and 400 parts of n-butyl methacrylate were charged and polymerized at 120° C. for 2 hours under a nitrogen stream. There-after, 750 parts of xylene were added and AIBN was added at 90° C. with an interval of 2 hours, 0.3 part at one time, to conduct polymerization for 8 hours. The molecular weight of the vinyl polymer (B-II) was measured. Mw=130,000, Mn=21,000, Mw/Mn=6.2.

Then, 1,000 parts of the solution of the vinyl polymer (B-I) and 875 parts of the solution of the vinyl polymer (B-II) were mixed and the solvents were removed to obtain a resin blend (B).

In exactly the same manner as in Example 1, the resin blend (B) was processed into a toner (B), which was then evaluated. Results are shown in Table 1.

EXAMPLE 3

A resin blend (C) was obtained by mixing a styrene-n-butyl methacrylate-methacrylic acid copolymer (weight proportions of the monomers: 60:37.5:2.5; Mw=243,000, Mn=29,000, Mw/Mn=8.4) and a styrene-dioctyl fumarate-methacrylic acid copolymer (weight proportions of the monomers: 90:7.5:2.5; Mw=18,500, Mn=8,000, Mw/Mn=2.3) at mixing weight proportions of 50:50 in xylol as a solvent and then removing the solvent. In exactly the same manner as in Example 1, the resin blend (C) was processed into a toner (C), which was then evaluated. Results are shown in Table 1.

COMPARATIVE EXAMPLE 1

A solution of a vinyl copolymer (D-I) was obtained in exactly the same manner as in Example 1 except that upon preparation of the vinyl copolymer (A-I), dioctyl fumarate was changed to n-butyl methacrylate. The molecular weight of the vinyl copolymer (D-I) was measured. Mw=8,700, Mn=3,500, Mw/Mn=2.5. In the same manner as in Example 1, the solution of the vinyl copolymer was mixed with the polystyrene resin to produce a toner (D), which was then evaluated. Results are given in Table 1.

COMPARATIVE EXAMPLE 2

A solution of a vinyl copolymer (E-I) was prepared in exactly the same manner as in Example 1 except that upon preparation of the vinyl copolymer (A-I), 980 parts of styrene and 20 parts of dioctyl fumarate were used. The molecular weight of the vinyl copolymer (E-I) was measured. Mw=8,900, Mn=3,700, Mw/Mn=2.4. In the same manner as in Example 1, the solution of the vinyl copolymer was mixed with the polystyrene resin to produce a toner (E), which was then evaluated. Results are given in Table 1.

EXAMPLE 4

A solution of a vinyl copolymer (F-I) was prepared in exactly the same manner as in Example 2 except that 900 parts of styrene and 100 parts of dibutyl fumarate were changed to 850 parts of styrene and 150 parts of diisopropyl fumarate respectively. The molecular weight of the vinyl copolymer (F-I) was measured. Mw=8,800, Mn=3,500, Mw/Mn=2.5.

In exactly the same manner as in Example 2, 1,000 parts of the solution of the vinyl copolymer (F-I) and 875 parts of the solution of the vinyl polymer (B-II) were mixed and the solvents were then removed to produce a toner (F), which was then evaluated. Results are given in Table 1.

EXAMPLE 5

A solution of a vinyl copolymer (G-I) was prepared in exactly the same manner as in Example 2 except that 900 parts of styrene were changed to 870 parts of styrene and 30 parts of monooctyl fumarate respectively. The molecular weight of the vinyl copolymer (G-I) was measured. Mw=13,200, Mn =5,500, Mw/Mn=2.4.

In the same manner as in Example 2, the solution of the vinyl copolymer and the solution of the vinyl polymer (B-II) were mixed and the solvents were then removed to produce a toner (G), which was then evaluated. Results are given in Table 1.

COMPARATIVE EXAMPLE 3

A solution of a vinyl copolymer (H-I) was prepared in exactly the same manner as in Example 2 except that upon preparation of the vinyl copolymer (B-I), fumaric acid was employed in lieu of dibutyl fumarate. The molecular weight of the vinyl copolymer (H-I) was measured. Mw=15,600, Mn=6,000, Mw/Mn=2.6. In the same manner as in Example 2, the solution of the vinyl copolymer was mixed with the the solution of the vinyl polymer (B-II) and the solvents were removed to produce a toner (H), which was then evaluated. Results are given in Table 1.

COMPARATIVE EXAMPLE 4

A solution of a vinyl copolymer (I-I) was prepared in exactly the same manner as in Example 2 except that upon preparation of the vinyl copolymer (B-I) dilauryl fumarate was employed in place of dibutyl fumarate. The molecular weight of the vinyl copolymer (I-I) was measured. Mw=9,200, Mn=3,200, Mw/Mn=2.9. In the same manner as in Example 2, the solution of the vinyl copolymer was mixed with the the solution of the vinyl polymer (B-II) and the solvents were removed to produce a toner (I), which was then evaluated. Results are given in Table 1.

a sheet of paper and hence smears the background area. When this phenomenon is not induced at a fixing temperature of 220° C., the toner is evaluated to have good anti-offset property. Otherwise, the toner is qualified to have poor anti-offset property.

Continuous copying performance

After continuously making 10,000 copies, the mark quality of the last copy was compared with the mark quality in the beginning in order to evaluate the continuous copying performance. When good mark quality was still produced, the toner was evaluated to have good continuous copying performance. Otherwise, the toner is qualified to have poor continuous copying performance.

Triboelectricity

The triboelectricity was measured both at the beginning and after continuous copying of 10,000 copies.

TABLE 1

| | Example | | | | | Comparative Example | | | |
|---|---|---|---|---|---|---|---|---|---|
| | 1 | 2 | 3 | 4 | 5 | 1 | 2 | 3 | 4 |
| Vinyl copolymer (I) | | | | | | | | | |
| Monomers | | | | | | | | | |
| Aromatic vinyl monomer | Styrene | Styrene | Styrene | Styrene | Styrene | Styrene | Styrene | Styrene | Styrene |
| (wt. %)) | 90 | 90 | 90 | 85 | 87 | 90 | 98 | 90 | 90 |
| Fumaric ester | Dioctyl | Dibutyl | Dioctyl | Isopropyl | Dibutyl | (n-Butyl | Dioctyl | — | Dilauryl |
| (wt. %) | 10 | 10 | 7.5 | 15 | 10 Monooctyl 3 | metha-crylate) 10 | 2 | | 10 |
| Acid monomer | — | — | Metha-crylic | — | — | | — | Fumaric acid | — |
| (wt. %) | | | 2.5 | | | | | 10 | |
| Molecular weight (Mn) | 3,000 | 3,200 | 8,000 | 3,500 | 5,500 | 3,500 | 3,700 | 6,000 | 3,200 |
| Vinyl polymer (II) | | | | | | | | | |
| Monomer | Styrene | Styrene, n-butyl metha-crylate | Styrene, n-butyl metha-crylate, metha-crylic acid | Styrene, n-butyl metha-crylate | Styrene, n-butyl metha-crylate | Styrene | Styrene | Styrene, n-butyl metha-crylate | Styrene, n-butyl metha-crylate |
| Molecular weight (Mn) | 70,000 | 21,000 | 29,000 | 21,000 | 21,000 | 70,000 | 70,000 | 21,000 | 21,000 |
| Weight proportions of the polymers (I/II) | 77/23 | 50/50 | 50/50 | 50/50 | 50/50 | 77/23 | 77/23 | 50/50 | 50/50 |
| Evaluation as toner | | | | | | | | | |
| Fixation (°C.) | 140 | 130 | 140 | 130 | 130 | 180 | 170 | 170 | 160 |
| Anti-offset property | Good | Good | Good | Good | Good | Good | Good | Good | Good |
| Continuous copying performance (mark quality) | Good | Good | Good | Good | Good | Poor | Poor | Poor | Poor |
| Continuous copying performance (triboelectricity) | 103 | 108 | 109 | 107 | 109 | 175 | 108 | 160 | 110 |
| Blocking resistance | ○ | ○ | ○ | ○ | ○ | ○ | ◎ | ◎ | ◎ |

In Table 1, the properties were determined in the following manner.

Fixation

A solid part of each copied sheet was folded and rubbed thoroughly with a nail. The fixation was evaluated by observing whether the toner was easily flaked or cracked off or not at the crease. Each value given in the Table indicates the lowest temperature for achieving chipping-free fixing. The lower this value, the better the fixation.

Anti-offset property

The term "offset" means a phenomenon that a portion of a toner adheres on a fixing roll and after rotation of the roll, the toner adheres on the background area of Triboelectricity is expressed by the following equation:

$$\text{Triboelectricity} = \frac{\text{Charge after copying 10,000 copies}}{\text{Initial triboelectricity}} \times 100\ (\%)$$

Triboelectricity is evaluated to be good when the above value falls within 100±20 (%).

Blocking resistance

About 10 cc of each toner was placed in a glass bottle the capacity of which was 20 cc. After allowing the toner to stand at 50° C. for 24 hours in the glass bottle, the degree of its caking was investigated in accordance with the following standard.

:No caking took place. Toner flowed out of the glass bottle when the tube was simply turned upside down.

:Toner flowed out of the glass bottle when a bottom part of the tube was tapped.

X: Toner hardly flowed out of the glass bottle even when a bottom part of the tube was struck.

Having now fully described the invention, it will be apparent to one of ordinary skill in the art that many changes and modifications can be made thereto without departing from the spirit or scope of the invention as set forth herein.

We claim:

1. In a process of developing latent electrostatic images in a high speed electrophotographic copying machine, the improvement comprising:

contacting the latent electrostatic images with a toner material comprising a coloringly effective amount of a colorant in combination with a resin blend composed of: (A) 40–90 wt. % of a vinyl copolymer (I) forced of 70–97 wt. % of an aromatic vinyl monomer, 3–30 wt. % of an alkyl fumerate which is a $C_{1-8}$ monoalkyl or dialkyl ester and 0–5 wt. % of an acid monomer and having a number average molecular weight of 2,000–15,000; and (B) 10–60 wt. % of a vinyl polymer (II) having a number average molecular eight of 20,000–500,000.

2. The process of claim 1, wherein the toner is in the form of particles which have a particle size ranging from I0–20 μm.

3. The process of claim 2, wherein the aromatic vinyl monomer is selected from the group consisting of styrene, α-methylstyrene, p-methylstyrene, vinyltoluene and chlorostyrene.

4. The process of claim 2, wherein the alkyl fumerate is a $C_{4-8}$ monoalkyl or dialkyl ester.

5. The process of claim 2, wherein the acid monomer is selected from the group consisting of methacrylic acid, acrylic acid, itaconic acid, fumaric acid and cinnamic acid.

6. The process of claim 2, wherein the vinyl monomer forming the vinyl polymer (II) is selected from the group consisting of aromatic vinyl monomers, acrylic esters, methacrylic esters, vinyl monomers containing nitrile groups, unsaturated carboxylic acids, mono- and di-alkyl esters of unsaturated dibasic acids, vinyl monomers containing amide groups and other nitrogen-containing vinyl monomers.

7. The process of claim 2, wherein the total amount of the monoalkyl fumarate and acid monomer is 5 wt. % or less.

8. The process of claim 2, wherein the blending of the vinyl copolymer (I) and vinyl polymer (II) is effected by adding and mixing the vinyl polymer (II) with a polymerization mixture, which has been obtained upon completion of polymeriza-tion of the vinyl copolymer (I) and contains a solvent, and then removing the solvent.

9. The process of claim 2, wherein the blending of the vinyl copolymer (I) and vinyl polymer (II) is effected by adding dropwise the monomers for the vinyl copolymer (I) together with a catalyst to a solution of the vinyl polymer (II) in a solvent, polymerizing the monomers and then removing the solvent.

* * * * *